US006564604B2

(12) United States Patent
Kefferstein et al.

(10) Patent No.: US 6,564,604 B2
(45) Date of Patent: May 20, 2003

(54) PROCESS FOR THE MANUFACTURE OF A PART WITH VERY HIGH MECHANICAL PROPERTIES, FORMED BY STAMPING OF A STRIP OF ROLLED STEEL SHEET AND MORE PARTICULARLY HOT ROLLED AND COATED

(75) Inventors: Ronald Kefferstein, Saint Victoret (FR); Xavier Jartoux, La Saladelle (FR)

(73) Assignee: Unisor, Puteaux (FR)

( * ) Notice: Subject to any disclaimer, the term of this patent is extended or adjusted under 35 U.S.C. 154(b) by 0 days.

(21) Appl. No.: 09/827,167

(22) Filed: Apr. 6, 2001

(65) Prior Publication Data

US 2001/0042393 A1 Nov. 22, 2001

(30) Foreign Application Priority Data

Apr. 7, 2000 (FR) ..... 00 04427

(51) Int. Cl.[7] ..... B21D 22/00
(52) U.S. Cl. ..... 72/47
(58) Field of Search ..... 72/47

(56) References Cited

U.S. PATENT DOCUMENTS 3,248,251 A 4/1966 Allen
3,271,850 A * 9/1966 Menne et al. ..... 72/47
3,765,206 A * 10/1973 Shah et al. ..... 72/47
3,820,368 A * 6/1974 Fukuzuka et al. ..... 72/47
3,838,495 A * 10/1974 Kuhnert ..... 72/47
4,155,235 A * 5/1979 Pierson et al. ..... 72/47

FOREIGN PATENT DOCUMENTS

| | | | |
|---|---|---|---|
| EP | A-0438607 | 7/1991 | |
| FR | A-537 122 | 5/1922 | |
| FR | A-857 779 | 9/1940 | |
| FR | 1297906 | * 5/1962 | ..... 72/47 |
| FR | A-2534161 | 4/1984 | |
| GB | 763368 | * 12/1956 | ..... 72/47 |

* cited by examiner

*Primary Examiner*—Lowell A. Larson
(74) *Attorney, Agent, or Firm*—Sughrue Mion, PLLC

(57) ABSTRACT

A process for the manufacture of a part with very high mechanical properties, formed by stamping of a strip of rolled steel sheet and more particularly hot rolled and coated with a metal or metal alloy ensuring protection of the surface and the steel, whereby:

the steel sheet is cut to obtain a steel sheet blank, the steel sheet blank is stamped to obtain the part, an alloyed intermetallic compound is applied to the surface, before or after the stamping, ensuring protection against corrosion, against steel decarburization, which intermetallic compound may provide a lubrication function, the excess material from the steel sheet required for the stamping operation is trimmed.

7 Claims, 2 Drawing Sheets

Before cold-stamping and heat treatment

After cold-stamping and heat treatment

Before heat-stamping and heat treatment

After heat-stamping and heat treatment

PROCESS FOR THE MANUFACTURE OF A PART WITH VERY HIGH MECHANICAL PROPERTIES, FORMED BY STAMPING OF A STRIP OF ROLLED STEEL SHEET AND MORE PARTICULARLY HOT ROLLED AND COATED

The invention concerns a process for the manufacture of a part with very high mechanical properties, formed by stamping of a strip of rolled steel sheet and more particularly hot rolled and coated with a metal or metal alloy ensuring protection of the surface and the steel.

The steel sheets intended for high temperature forming and/or heat treatment are not delivered with a coating in view of the retention of the coating during the heat treatment, as steels are generally heat treated at relatively high temperatures, far in excess of 700° C. Indeed, zinc coating deposited on a metallic surface was considered heretofore as likely to melt, flow, foul the hot forming tools during the heat treatment at temperatures in excess of the zinc melting temperature, and degrade during quenching.

Therefore, the coating is applied on the finished part, which necessitates careful cleaning of the surfaces and hollow areas. Said cleaning requires the use of acids or bases, whose recycling and storage entail significant financial costs and risks for the operators and the environment. In addition, heat treatment must be performed under controlled atmosphere in order to prevent any steel decarburization and oxidation. Furthermore, in the heat forming process, carbon buildup damages the forming tools because of its abrasiveness, which diminishes the dimensional and aesthetic quality of the parts produced or requires frequent and costly tool repairs. Finally, in order to increase their resistance to corrosion, the parts thus obtained must undergo costly post-treatment, whose application is difficult or even impossible, in particular for parts with hollow areas. Post-coating of steels with very high mechanical properties also has the drawback of creating risks of fragilization due to hydrogen in electrogalvanizing or of alteration of the mechanical properties of the steels in bath galvanizing of previously formed parts.

The purpose of the invention is to provide users with rolled steel sheets of 0.2 mm to 4 mm in thickness, coated in particular after hot rolling, to undergo either hot or cold forming, followed by heat treatment, as well as a process for the production of parts by hot forming, using these coated rolled steel sheets, where the rise in temperature is ensured without decarburization of the steel of the sheet, without oxidation of the surface of said steel sheet, before, during and after the hot forming and/or the heat treatment.

The invention concerns a process for the manufacture of a part with very, high mechanical properties, formed by stamping of a strip of rolled steel sheet and more particularly hot rolled and coated with a metal or metal alloy ensuring protection of the surface and the steel, whereby:

- the steel sheet is cut to obtain a steel sheet blank,
- the steel sheet blank is stamped to obtain the part,
- an alloyed intermetallic compound is applied to the surface, before or after the stamping, ensuring protection against corrosion, against steel decarburization, which intermetallic compound may provide a lubrication function,
- the excess material from the steel sheet required for the stamping operation is trimmed.

In a preferred embodiment of the invention,

- the steel sheet is cut to obtain a steel sheet blank,

- the coated steel sheet blank is subjected to a rise in temperature in order to hot-form a part,
- an alloyed intermetallic compound is thereby formed at the surface of the part, ensuring protection against corrosion, against steel decarburization, which intermetallic compound may provide a lubrication function,
- the steel sheet blank is fabricated by stamping,
- the stamped part is cooled to obtain such mechanical properties in the steel as high hardness and high surface hardness of the coating,
- the excess material from the steel sheet required for the stamping operation is trimmed.

The other characteristics of the invention include:

- the metal or metallic alloy of the coating is zinc or a zinc-based alloy of a thickness ranging from 5 $\mu$m to 30 $\mu$m.
- the intermetallic alloy is a zinc-iron based compound or a zinc-iron-aluminum based alloy.
- the coated steel sheet is subjected to a rise in temperature in excess of 700° C. prior to the stamping and/or heat treatment.
- the part obtained in particular by stamping is cooled so that it is quenched at a rate higher than the critical cooling rate.

The invention also concerns the use of a strip of rolled steel sheet and more particularly hot rolled and coated with a metal or metal alloy ensuring protection of the surface and the steel of the steel sheet in the forming by stamping, in particular hot forming of parts, such parts having high mechanical properties as regards hardness and high surface hardness as well as very good resistance to abrasion.

The following narrative and the figures provided in annex clearly describe the invention.

Figure 3A:
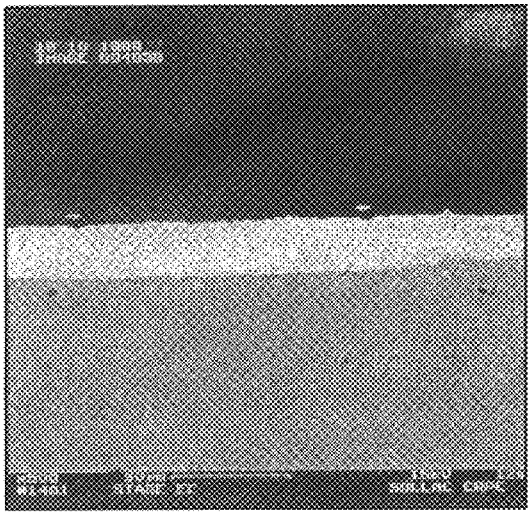
Figure 3B:
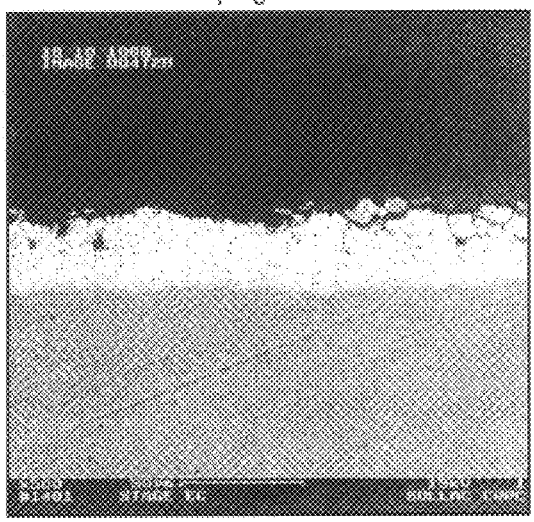

FIGS. 3*a* and 3*b* are photographs of cross-sectional segments of a part showing a zinc coating obtained by the invention, before and after the heat treatment.

Figure 4A:
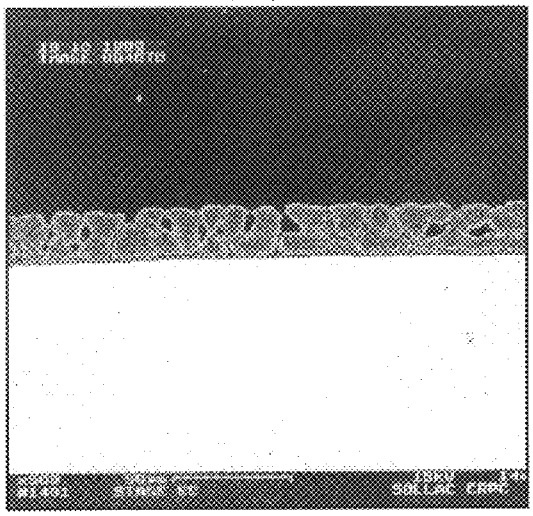
Figure 4B:
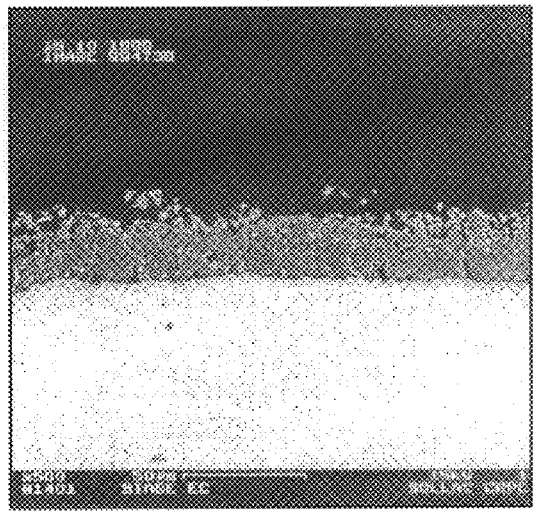

FIGS. 4*a* and 4*b* are photographs of cross-sectional segments of a part showing a zinc-aluminum coating obtained by the invention, before and after heat treatment.

Figure 1:
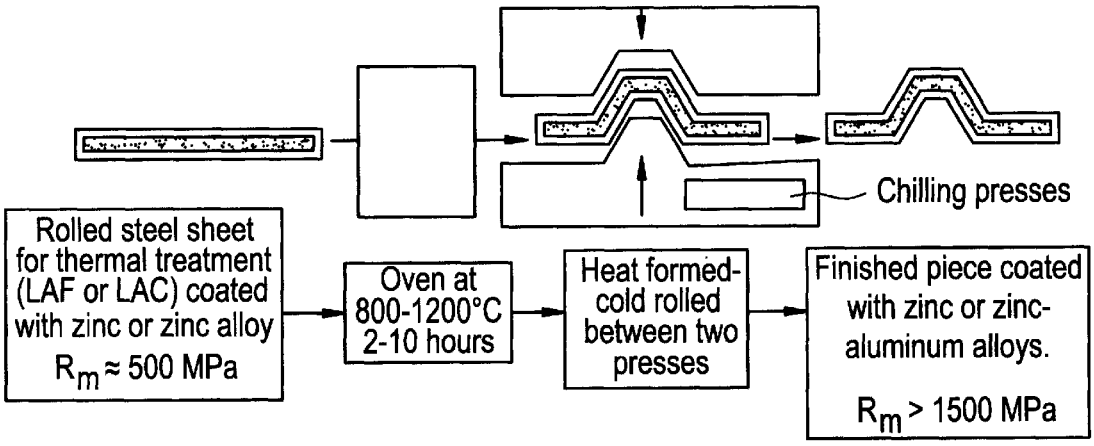
FIG. 1 is a schematic diagram of one embodiment of the invention.

The process according to the invention as shown in the FIG. 1 diagram consists in manufacturing, from steel sheet for heat treatment or hot forming, in particular hot rolled and coated with zinc or a zinc-based alloy, a part by hot forming using such a tool as a drawing press.

The zinc or zinc alloy coated is selected so as to provide protection against corrosion of the base steel sheet in reel.

Contrary to preconceived ideas, during heat treatment or temperature rise for hot forming, the coating forms a layer alloying with the steel of the strip and presents then a mechanical resistance such that it prevents the coating material from melting. The resulting compound presents high resistance to corrosion, abrasion, wear and fatigue. The coating does not alter the steel formability properties, thus allowing a wide range of cold and hot forming operations.

In addition, the use of zinc or zinc alloy provides galvanic protection of the edges when the steel sheet blank has cut-out areas.

After hot rolling, the steel strip may be pickled and cold rolled prior to coating. Where the steel sheet has been cold rolled, it may be annealed prior to coating.

The rolled steel sheet may be coated, for instance, with zinc or zinc-aluminum alloys.

Figure 2:
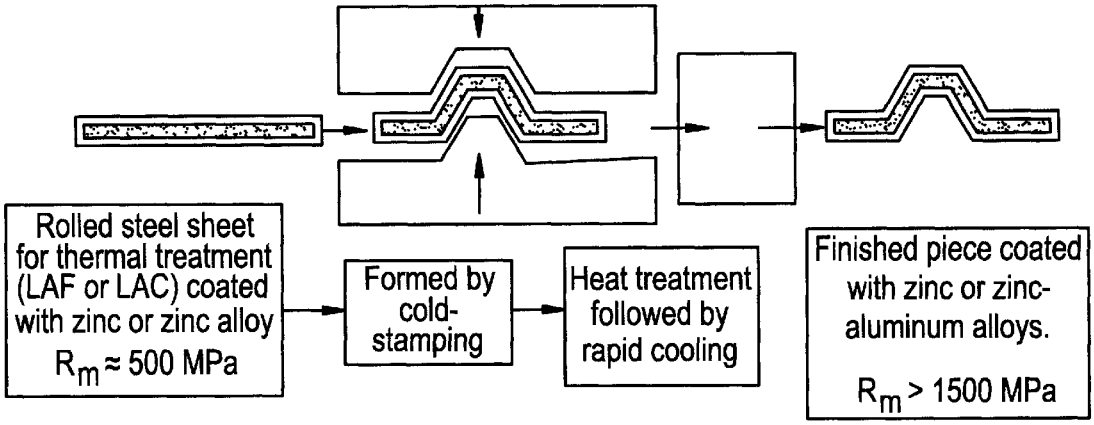
FIG. 2 is a schematic diagram of another embodiment of the invention.

As shown in the diagram in FIG. 2, the steel sheet may be cold-stamped to obtain the part. The part thus obtained is then heat treated to impart it with high mechanical properties. For instance, a base steel with a tensile strength (ts) of approximately 500 MPa will allow the production of heat treated parts where the steel will have a tensile strength (ts) higher than 1,500 MPa.

For the forming or heat treating of the part, the steel sheet is subjected to a rise in temperature preferably ranging between 700° C. and 1,200° C. in an oven where the atmosphere no longer needs to be controlled due to the barrier to oxidation provided by the coating. During the rise in temperature, the zinc-based coating becomes an alloyed surface layer with different phases depending on the heat treatment and with high hardness capable of exceeding VH 600/100 g.

In the process according to the invention, it is possible to use steel sheets of a thickness ranging from 0.2 mm to 4 mm, with good forming properties as well as good resistance to corrosion.

The coated steel sheets delivered demonstrate important resistance to corrosion during temperature rises, forming, heat treatment and the use of the finished formed parts.

In addition to avoiding corrosion, the presence of the coating during the heat treatment or hot forming process also prevents decarburization of the base steel. This is an undeniable advantage, for instance, for hot forming with a drawing press. That is because the resulting intermetallic alloy prevents the buildup of carbon and tools wearing off due to said buildup, thus extending the average service life of said tools. It was observed that the intermetallic alloy formed under heat acts as a lubricant at high temperatures. In addition, the protection against decarburization provided by the intermetallic alloy makes it possible to use high temperature ovens above 900° C. without requiring atmosphere control, even with heat times of several minutes.

When the parts are taken out of the ovens, they no longer have to be pickled, hence cost savings as a result of the elimination of the pickling solution for the finished parts.

Due to the properties of the coating after the rise in temperature, the parts produced have increased resistance to fatigue, wear, abrasion and corrosion, including on the edges due to the galvanic behavior of zinc with steel. In addition, the coating can be soldered before and after the rise in temperature.

As a result of the quenching effect at cooling, the sheet steel provides the manufactured part with high mechanical properties after forming, while the coating transformed into an intermetallic alloy under heat provides an improvement in forming, in particular hot forming, due to its lubricant and abrasion resistance properties.

EXAMPLE 1

Zinc Coating Over Steel

In a sample embodiment, a strip of hot rolled steel with the following weight composition is used:

carbon: 0.15% to 0.25%
manganese: 0.8% to 1,5%
silicon: 0.1% to 0.35%
chromium: 0.01% to 0.2%
titanium: less than 0.1%
aluminum: less than 0.1%
phosphorus: less than 0.05%
sulfur: less than 0.03%
boron: 0.0005% to 0.01%.

A part is manufactured from cold rolled steel sheet of 1 mm in thickness and continuously galvanized on both side with a coating of approximately 10 $\mu$m. The steel sheet is austenitized at 950° C. before forming and quenching in the tool, with the coating acting as a lubricant during the forming, in addition to providing protection against corrosion, in cold and hot circumstances and against decarburization. During quenching, the alloyed coating does not hinder heat extraction by the tool and may enhance it. After forming and quenching, it is no longer necessary to pickle the part or to protect it as the base coating provides protection throughout the entire process.

After forming, and thus heat treatment, the manufactured part presents a gray, matte appearance, without flash or bubbles, flaking or fissures, and with no carbon buildup on the edges in cross-sections. Observation with a scanning electron microscope in surface and cross-section shows that the coating retains a homogeneous structure and texture and that the Fe—Zn alloying occurs within less than 5 minutes at 950° C.

The coating includes, as represented comparatively in FIGS. 3*a* and 3*b* representing respectively cross-sections of the coating before and after heat treatment, a Zn-diffusion interface ranging from 5 $\mu$m to 10 $\mu$m, and a layer formed by Zn—Fe nodules in a zinc matrix, the thickness of said layer ranging from 10 $\mu$m to 15 $\mu$m.

Corrosion tests for resistance to humidity and temperature according to DIN Norm 50 017 show that the coating according to the invention provides excellent protection against corrosion after 30 cycles, with the surfaces of the parts retaining their gray appearance.

Table 1 below shows the loss of weight due to corrosion after 500 and 1,000 hours exposure to salt mist, for uncoated control steel, galvanized control steel with no heat treatment, and steel according to two embodiments of the invention:

TABLE 1

| | Loss of weight in g/m$^2$ after 500 hours | Loss of weight in g/m$^2$ after 1,000 hours |
|---|---|---|
| Control steel | 450 g/m$^2$ | 1,230 g/m$^2$ |
| Control galvanized steel | 80 g/m$^2$ | 140 g/m$^2$ |
| Zn coated steel after heat treatment | 32 g/m$^2$ | 82 g/m$^2$ |
| Zn—Al coated steel after heat treatment | 22 g/m$^2$ | 50 g/m$^2$ |

As may be noted, coating after heat treatment provides good resistance to salt mist. In addition, this surface, consisting of zinc and iron, can be phosphated in conventional surface treatment solutions of the phosphatizing-trication type. Corrosion tests conducted after phosphatizing and cataphoretic paint application show excellent results. In addition, the zinc-iron alloy layer provides galvanic protection of the edges of the cathode protection type.

EXAMPLE 2

Zinc-aluminum Coating Over Steel.

A 10 $\mu$m coating is applied to a steel sheet of approximately 1 mm. This coating contains 50 to 55% aluminum and 45 to 50% zinc, possibly with a small quantity of silicon.

The cross-sectional appearance of this coating, after hot forming is shown in FIGS. 4*a* and 4*b*.

During the hot forming process, zinc, aluminum and iron alloy to form a homogeneous, adherent zinc-aluminum-iron coating. Corrosion tests show that this alloyed coating provides very good protection against corrosion.

What is claimed is:

1. A process for the manufacture of a part with very high mechanical properties, said part formed by stamping of a strip of rolled steel sheet rolled and coated with a metal or metal alloy ensuring protection of the surface and the steel, said process comprising the steps:

cutting the steel sheet to obtain a steel sheet blank, stamping the steel sheet blank to obtain the part, generating an alloyed compound on a surface of the strip of rolled steel sheet, before the stamping, said alloyed compound ensuring protection against corrosion and steel decarburization, and providing a lubrication function, and trimming excess material from the steel sheet required for the stamping operation.

2. The process according to claim 1, further comprising:

after the steel blank is cut to obtain the steel sheet blank, subjecting the coated steel sheet blank to a rise in temperature in order to hot-form a part, thereby forming the alloyed compound at the surface of the part, said alloyed compound ensuring protection against corrosion and steel decarburization, and providing a lubrication function, cooling the stamped part to obtain such mechanical properties in the steel as high hardness and high surface hardness of the coating.

3. A process according to claim 1 wherein the metal or metal alloy for the coating is zinc or a zinc-based alloy of a thickness ranging from 5 $\mu$m to 30 $\mu$m.

4. The process according to claim 1, wherein the alloyed compound is a zinc-iron or zinc-iron-aluminum based compound.

5. The process according to claim 1, wherein the coated steel sheet is subjected to a rise in temperature in excess of 700° C. prior to at least one of a stamping and heat treatment.

6. The process according to claim 5, wherein the coated steel sheet is subjected to a rise in temperature in excess of 700° C. in an oven and wherein an atmosphere of the oven is not controlled.

7. The process according to claim 1, wherein the part obtained in particular by stamping is cooled so that it is quenched at a rate higher than the critical quenching rate.

* * * * *

UNITED STATES PATENT AND TRADEMARK OFFICE

CERTIFICATE OF CORRECTION

PATENT NO. : 6,564,604 B2 
DATED : May 20, 2003
INVENTOR(S) : Ronald Kefferstein and Xavier Jartoux It is certified that error appears in the above-identified patent and that said Letters Patent is hereby corrected as shown below:

Drawings,
Figure 1, please change "LAF" to -- cold rolled -- and "LAC" to -- hot rolled --, as "LAF" and "LAC" are French equivalent acronyms of "cold rolled" and "hot rolled," respectively. Please change, "Oven at 800-1200°C 2-10 hours" to -- Oven at 800-1200° C 2-10 minutes --
Figure 2, please change "LAF" to -- cold rolled -- and "LAC" to -- hot rolled --, as "LAF" and "LAC" are French equivalent acronyms of "cold rolled" and "hot rolled," respectively.

Signed and Sealed this

Twenty-first Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,564,604 B2 
DATED : May 20, 2003
INVENTOR(S) : Kefferstein, Ronald and Jartoux, Xavier It is certified that error appears in the above-identified patent and that said Letters Patent is hereby corrected as shown below:

Title page,
Item [73], Assignee, please delete "UNISOR" and insert -- USINOR --

Signed and Sealed this

Second Day of August, 2005

JON W. DUDAS
*Director of the United States Patent and Trademark Office*